US010854410B2

(12) United States Patent
Shi et al.

(10) Patent No.: US 10,854,410 B2
(45) Date of Patent: Dec. 1, 2020

(54) HIGH-VOLTAGE DIRECT-CURRENT RELAY AND ASSEMBLY METHOD THEREFOR

(71) Applicant: Xiamen Hongfa Electric Power Controls Co., Ltd., Xiamen (CN)

(72) Inventors: Shengsheng Shi, Fujian (CN); Shuming Zhong, Fujian (CN)

(73) Assignee: Xiamen Hongfa Electric Power Controls Co., Ltd., Xiamen (CN)

( * ) Notice: Subject to any disclaimer, the term of this patent is extended or adjusted under 35 U.S.C. 154(b) by 0 days.

(21) Appl. No.: 16/064,023

(22) PCT Filed: Dec. 20, 2016

(86) PCT No.: PCT/CN2016/110954
§ 371 (c)(1),
(2) Date: Jun. 20, 2018

(87) PCT Pub. No.: WO2017/107893
PCT Pub. Date: Jun. 29, 2017

(65) Prior Publication Data

US 2019/0006140 A1 Jan. 3, 2019

(30) Foreign Application Priority Data

Dec. 22, 2015 (CN) ..... 2015 1 0971669

(51) Int. Cl.
*H01H 50/64* (2006.01)
*H01H 1/20* (2006.01)
(Continued)

(52) U.S. Cl.
CPC ..... *H01H 50/641* (2013.01); *H01H 1/2008* (2013.01); *H01H 1/50* (2013.01);
(Continued)

(58) Field of Classification Search
CPC .... H01H 50/641; H01H 50/64; H01H 50/546; H01H 50/20; H01H 1/50; H01H 1/2008; H01H 1/18; H01H 49/00
(Continued)

(56) References Cited

U.S. PATENT DOCUMENTS 9,269,507 B2 * 2/2016 Enomoto ..... H01H 50/546
2015/0194284 A1 * 7/2015 Uruma ..... H01H 1/06 335/179

FOREIGN PATENT DOCUMENTS

CN 1161556 A 10/1997
CN 102834891 A 12/2012
(Continued)

OTHER PUBLICATIONS

Office Action in corresponding Japanese application JP2018-550642, dated Jun. 25, 2019.
(Continued)

*Primary Examiner* — Edwin A. Leon
*Assistant Examiner* — Lheiren Mae A Caroc
(74) *Attorney, Agent, or Firm* — Renner, Otto, Boisselle & Sklar, LLP

(57) ABSTRACT

A high-voltage direct-current relay includes two stationary contacts and a movable assembly, the movable assembly including a movable spring part, a main spring and a pushing rod assembly. The pushing rod assembly is composed of a pushing rod part and a U-shaped basket as two separate parts, the pushing rod part includes a fixing piece and a pushing rod fixed together with insulating plastic. The movable spring part and the U-shaped basket are mounted on the top of the pushing rod part, the two ends of the fixing piece are secured to the bottom of the side part of the U-shaped basket. The main spring is tightened between the bottom surface of the movable spring part and the insulating
(Continued)

plastic of the pushing rod part, and the movable spring of the movable spring part is pressed to the inner side of the top part of the U-shaped basket.

14 Claims, 15 Drawing Sheets

(51) Int. Cl.
*H01H 1/50* (2006.01)
*H01H 50/20* (2006.01)
*H01H 50/54* (2006.01)
*H01H 1/18* (2006.01)

(52) U.S. Cl.
CPC ..... *H01H 50/20* (2013.01); *H01H 50/546* (2013.01); *H01H 50/64* (2013.01); *H01H 1/18* (2013.01)

(58) Field of Classification Search
USPC ..... 200/502
See application file for complete search history.

(56) References Cited

FOREIGN PATENT DOCUMENTS

| | | | |
|---|---|---|---|
| CN | 203339074 | U | 12/2013 |
| CN | 104221119 | A | 12/2014 |
| CN | 104412353 | A | 3/2015 |
| CN | 105551897 | A | 5/2016 |
| CN | 205264627 | U | 5/2016 |
| DE | 10 2013 210 211 | A1 | 12/2014 |
| EP | 0 798 752 | A2 | 10/1997 |
| EP | 2 290 672 | A1 | 3/2011 |
| EP | 2 838 103 | A1 | 2/2015 |
| JP | S57-97351 | U | 6/1982 |
| JP | H05-128956 | A | 5/1993 |
| JP | 2006331756 | A | 12/2006 |
| JP | 2012-048907 | | 3/2012 |
| JP | 2013175436 | A | 9/2013 |
| JP | 2013-246873 | A | 12/2013 |
| JP | 2014232669 | A | 12/2014 |
| JP | 2015130260 | A | 7/2015 |

OTHER PUBLICATIONS

International Search Report and Written Opinion of the State Intellectual Property Office of the P. R. China for corresponding International Application No. PCT/CN2016/110954 dated Mar. 22, 2017 with English translation of International Search Report.
Office Action issued in corresponding Chinese Application No. 201510971669.X dated Apr. 12, 2017.
Extended European Search Report issued in corresponding European Application No. 16877703.5 dated Nov. 8, 2018.

* cited by examiner

HIGH-VOLTAGE DIRECT-CURRENT RELAY AND ASSEMBLY METHOD THEREFOR

This application is a national phase of International Application No. PCT/CN2016/110954 filed Dec. 20, 2016, and claims priority to Chinese Application No. 201510971669.X filed on Dec. 22, 2015, which is incorporated herein by reference.

TECHNICAL FIELD

The present disclosure relates to a direct-current relay, in particular to a high-voltage direct-current relay and an assembly method therefor.

BACKGROUND

A relay is an electronic control device. It has a control system (also called an input circuit) and a controlled system (also called an output circuit), and is usually applied in automatic control circuits. It is actually an "automatic switch" to control a larger current with a smaller current. Therefore, it plays a role such as automatic adjustment, safety protection, and circuit conversion in the circuit.

A DC relay is one kind of relay. Most of the existing DC relays adopt a movable spring direct-acting (also called solenoid direct-acting) scheme. The contact part of the DC relay includes two stationary contacts and a movable assembly. The movable assembly includes a movable spring part and a pushing rod assembly. The movable spring part is composed of a movable spring and movable contact points at both ends of and the movable spring. The movable spring is of a direct-acting type. When the movable contact points at both ends of the movable spring are respectively in contact with the two stationary contacts, current flows into one of the stationary contacts and then out of the other stationary contact through the movable spring. The movable spring part is mounted on one end of the pushing rod assembly, and the other end of the pushing rod assembly is connected to a movable iron core. When current is applied to the coil to move the movable iron core upward, the movable iron core drives the pushing rod assembly to move upwards, such that the movable contact points at both ends of the movable spring respectively contact the two stationary contacts. When the coil is disconnected from the current, the movable iron core is moved downward under action of a return spring, the movable iron core drives the pushing rod assembly to move downwards, such that the movable contact points at both ends of the movable spring move away from the two stationary contacts respectively. In the related art, a DC relay has a pushing rod assembly usually formed by integral injection molding (as disclosed in Patent Publication No. CN104412353A). The pushing rod assembly is used to inject the pushing rod and a U-shaped basket together. The pushing rod is configured to connect a movable iron core, and the U-shaped basket is configured to adapt to the movable spring part. Since the pushing rod and the U-shaped basket are formed by integral injection molding, it is difficult to ensure the accuracy of the pushing rod assembly, resulting in difficulty in injection molding. In addition, it is not convenient to mount the movable spring part, making it more difficult to realize automated assembly. On the other hand, the existing high-voltage direct-current relay has a drawback that it may generate arcs when a large current is applied, causing defects such as adhesion or burning of movable and stationary contact points.

This section provides background information related to the present disclosure which is not necessarily prior art.

SUMMARY

An objective of the present disclosure is to overcome the deficiencies in the related art and provide a high-voltage direct-current relay and an assembly method therefor. By splitting the pushing rod assembly into two separate parts, one of which is an injection molded part (i.e., the pushing rod part) which has characteristics of a simple structure, being convenient for molding, and being easy to achieve dimensional accuracy. Moreover, not only the assembly between the two parts is simple, but also it is easy to achieve the automatic assembly of the matching parts. In addition, it can effectively avoid the stuck when the contacts are connected, improve the anti-stuck ability.

The technical solution adopted by the present disclosure to solve the technical problems is as follows.

There is provided a high-voltage direct-current relay including two stationary contacts and a movable assembly, the movable assembly including a movable spring part, a main spring and a pushing rod assembly. The pushing rod assembly is composed of a pushing rod part and a U-shaped basket as two separate parts. The pushing rod part includes a fixing piece and a pushing rod fixed together with insulating plastic. After the main spring, the movable spring part and the U-shaped basket are sequentially mounted on the top of the pushing rod part, the two ends of the fixing piece are respectively secured to the bottom of the side part of the U-shaped basket, such that the main spring is elastically tightened between the bottom surface of the movable spring part and the insulating plastic of the pushing rod part, and the movable spring of the movable spring part is pressed to the inner side of the top part of the U-shaped basket.

There is also provided a method for assembling a high-voltage direct-current relay, including steps of:

A. forming a fixed piece and a pushing rod into a one-piece pushing rod part by injection mold;

B. sequentially mounting a main spring, a movable spring part and a U-shaped basket on the top of the pushing rod part;

C. utilizing the characteristics that two side parts of the U-shaped basket can be elastically opened, respectively snapping two ends of the fixing piece into clamping holes on the two side parts of the U-shaped basket, such that the main spring is elastically tightened between the bottom surface of the spring part and the insulating plastic of the pushing rod part, and pressing the movable spring of the movable spring part against the inner side of the top part of the U-shaped basket; and D. fixing the two ends of the fixing piece respectively to the clamping holes on the bottom of the two side parts of the U-shaped basket by riveting or laser welding.

With the above technical solution, compared with the related art, the beneficial effects obtained by the present disclosure are as follows.

(1) The pushing rod assembly is divided into two separate parts of a U-shaped basket and a pushing rod part, the U-shaped basket is made of a metal material (non-magnetic material is preferred), and the pushing rod part is integrally injection-molded by the pushing rod and the fixing piece made of a metal material. Since the parts involved in injection molding have a simple structure, the dimensional accuracy of the pushing rod part can be easily ensured, and the difficulty in injection molding can be greatly reduced.

(2) The pushing rod assembly is divided into two separate parts of a U-shaped basket and a pushing rod part, and the U-basket and the fixed piece of the pushing rod part adopt a clamping method. By such structure, the main spring, the movable spring part and the U-shaped basket are sequentially mounted on the top of the pushing rod part to facilitate the assembly of the movable spring part and the main spring. Such structure can adopt a "bottom-up" assembly method, and is easy to implement automated assembly.

(3) A first lug is provided on the inner side of the top part of the U-shaped basket, and the first lug is disposed on one side corresponding to the width of the movable spring, such that when the contact points are separated, due to the action of the first lug on the inner first lug of the U-shaped basket pressing against the movable spring, the movable spring is inclined to one side of the width. With such structure of the present disclosure, when the contact points are separated, the movable spring is inclined under the tension of the main spring such that the arc point is separated from the contact point to ensure a small contact resistance. When the contact points are closed, the movable spring starts to tilt to the level of the movable spring (that is, the final reliable contact between the movable contact point and the stationary contact point), such that the movable contact point and the stationary contact point "rolled" during the contact process, thereby effectively preventing stuck and improving the anti-stuck capability.

(4) Due to the adoption of the two conical springs, the structure of the present disclosure can ensure that the operating voltage of the product is small while ensuring the contact pressure, or the contact pressure of the product can be designed to be large to provide reliable contact for the product while ensuring the operating voltage. This is desirable for resisting large fault currents.

(5) With the third lug provided on the inner side of the top part of the U-shaped basket, which is disposed on one side corresponding to the length of the movable spring, when the contact points are separated, under the action of the third lug on the inner side of the top part of the U-shaped basket pressing against the movable spring, the movable spring is inclined to one side of the length. With such structure of the present disclosure, the movable spring part may be inclined in the length direction of the movable spring. When the movable contact point and the stationary contact are stuck, the inclination can greatly improve the separation ability of the product.

This section provides a summary of various implementations or examples of the technology described in the disclosure, and is not a comprehensive disclosure of the full scope or all features of the disclosed technology.

DETAILED DESCRIPTION

Figure 1:
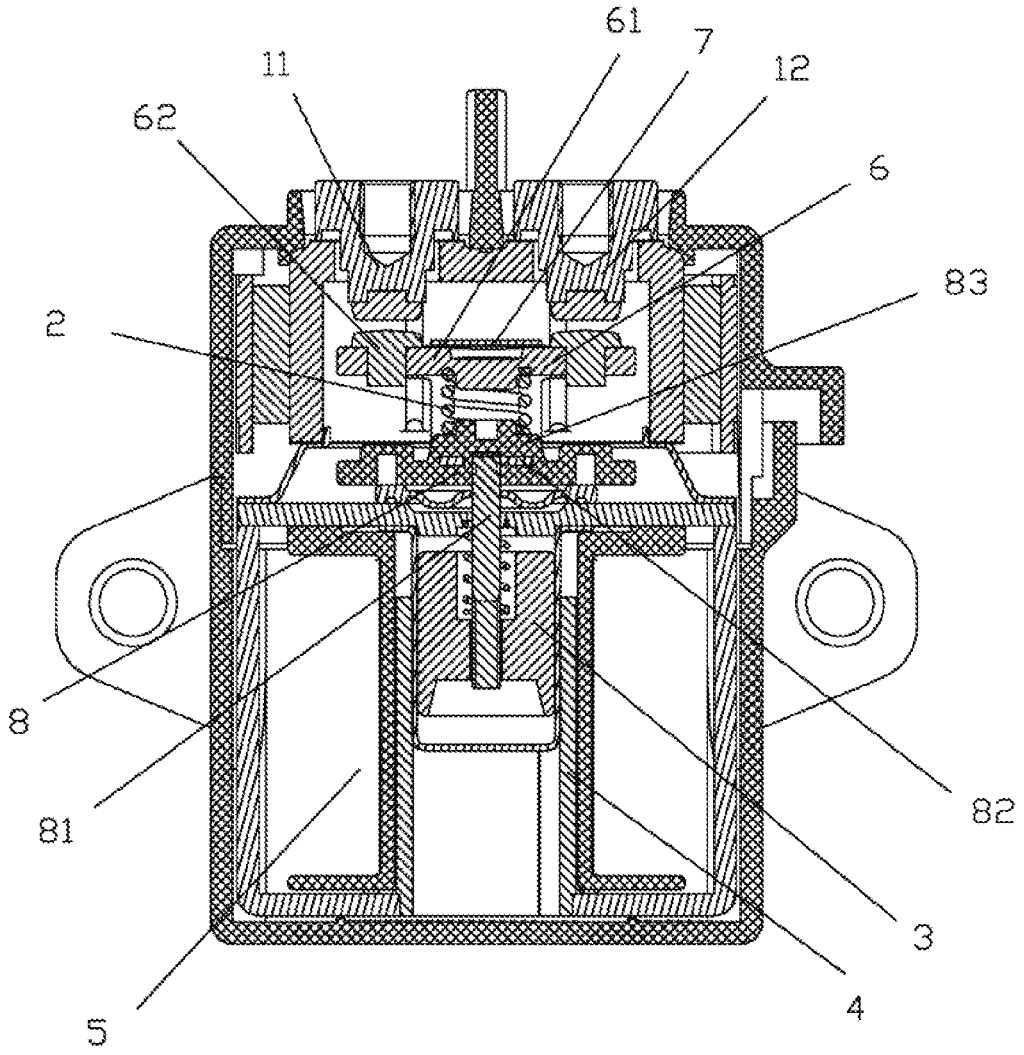
FIG. 1 is a schematic structural diagram of a high-voltage direct-current relay according to a first embodiment of the present disclosure.
Figure 2:
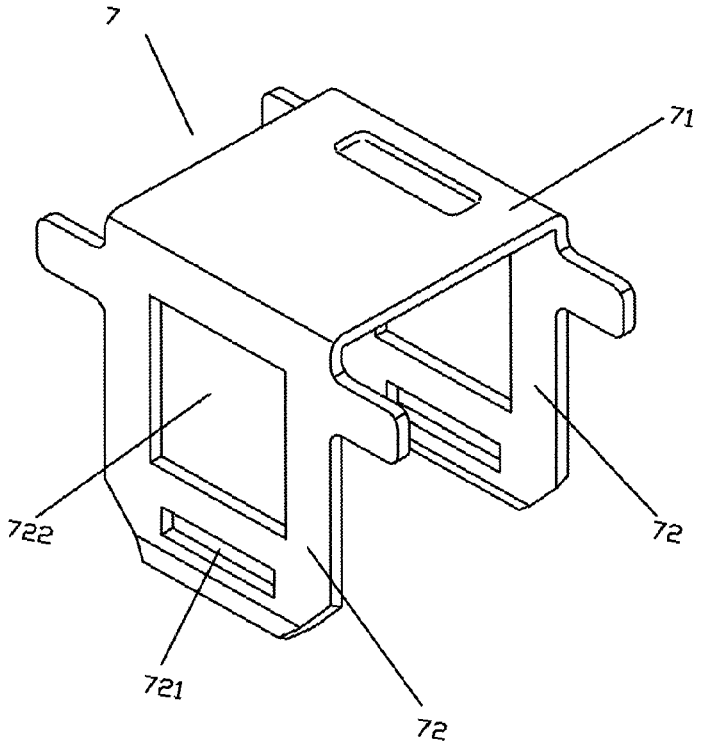
FIG. 2 is a three-dimensional structural schematic diagram of a U-shaped basket of a high-voltage direct-current relay according to the first embodiment of the present disclosure.
Figure 3:
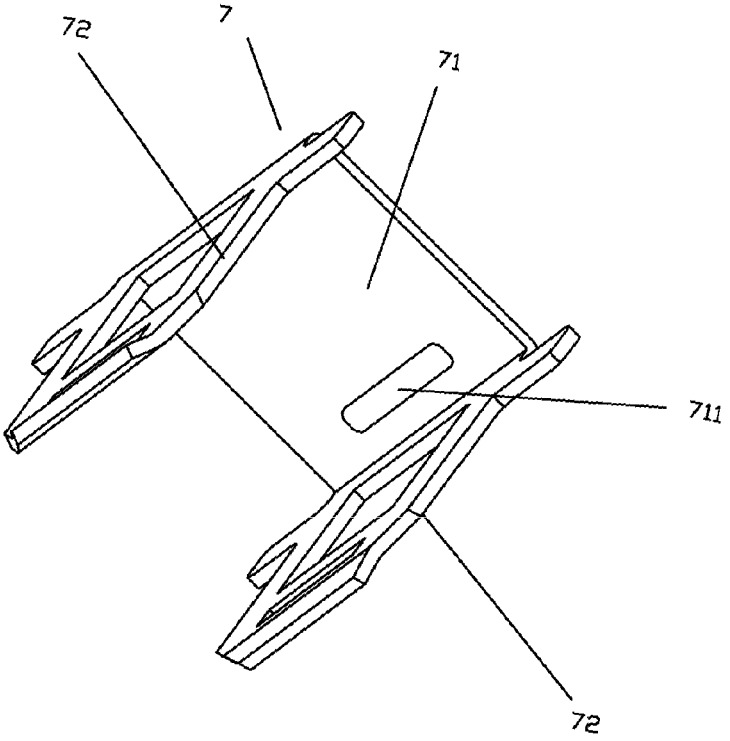
FIG. 3 is a three-dimensional structural schematic diagram of a U-shaped basket (viewing at an angle) of a high-voltage direct-current relay according to the first embodiment of the present disclosure.
Figure 4:
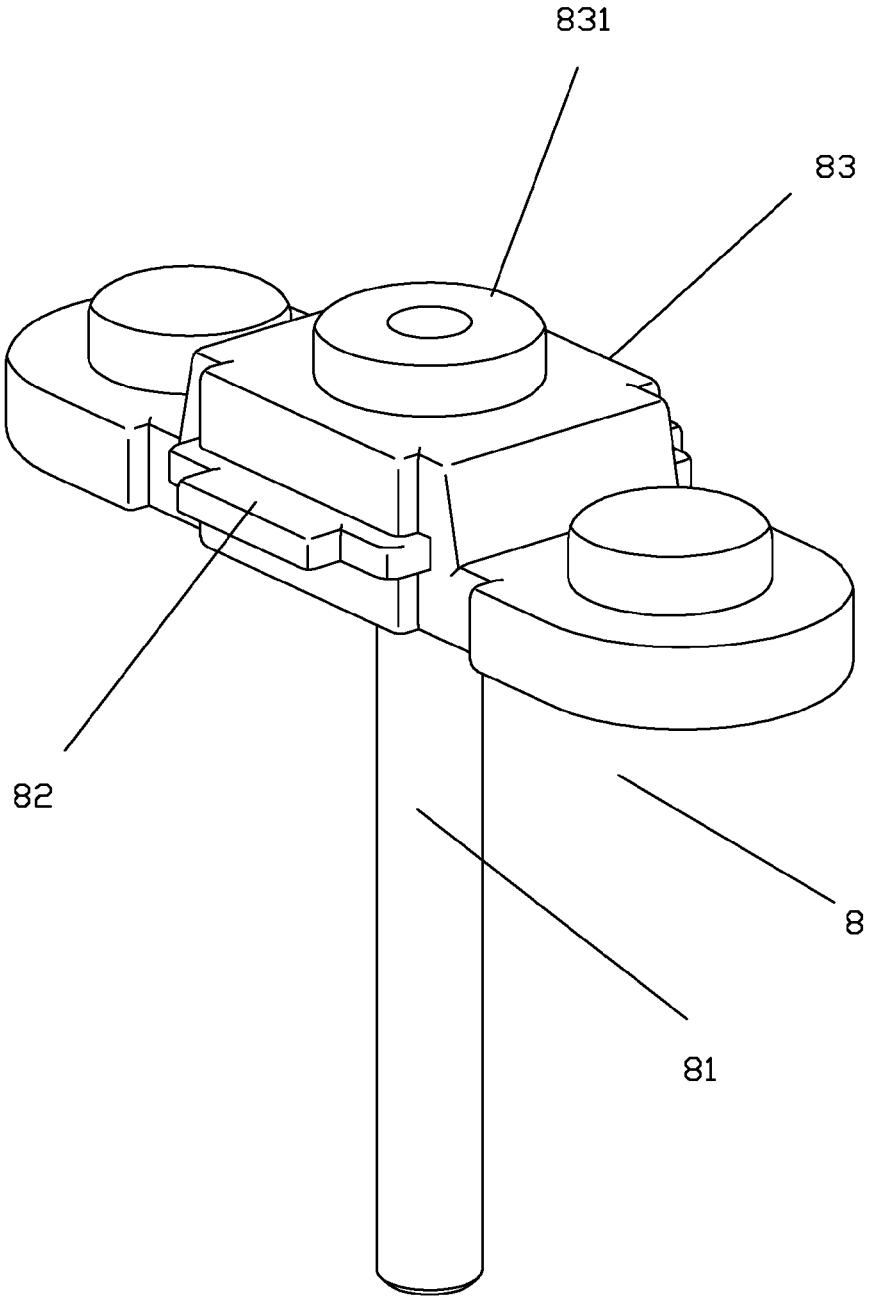
FIG. 4 is a schematic perspective diagram of a pushing rod part of a high-voltage direct-current relay according to the first embodiment of the present disclosure.
Figure 5:
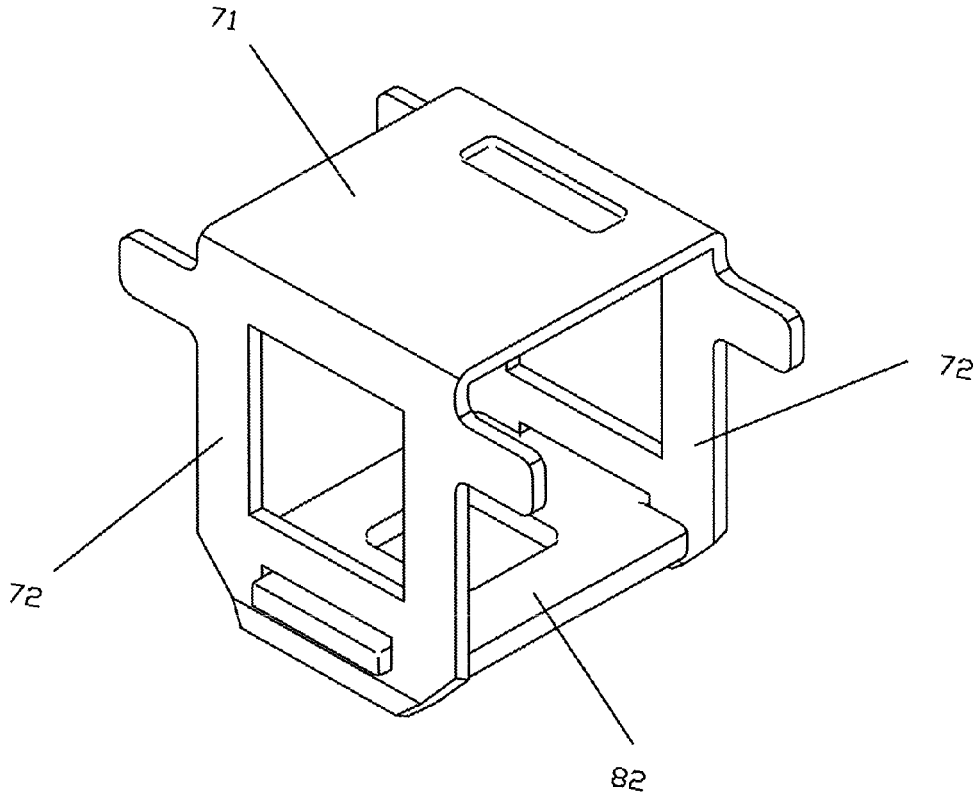
FIG. 5 is a schematic diagram of a fixing piece of a pushing rod part adapted to a U-shaped basket of a high-voltage direct-current relay according to the first embodiment of the present disclosure.
Figure 6:
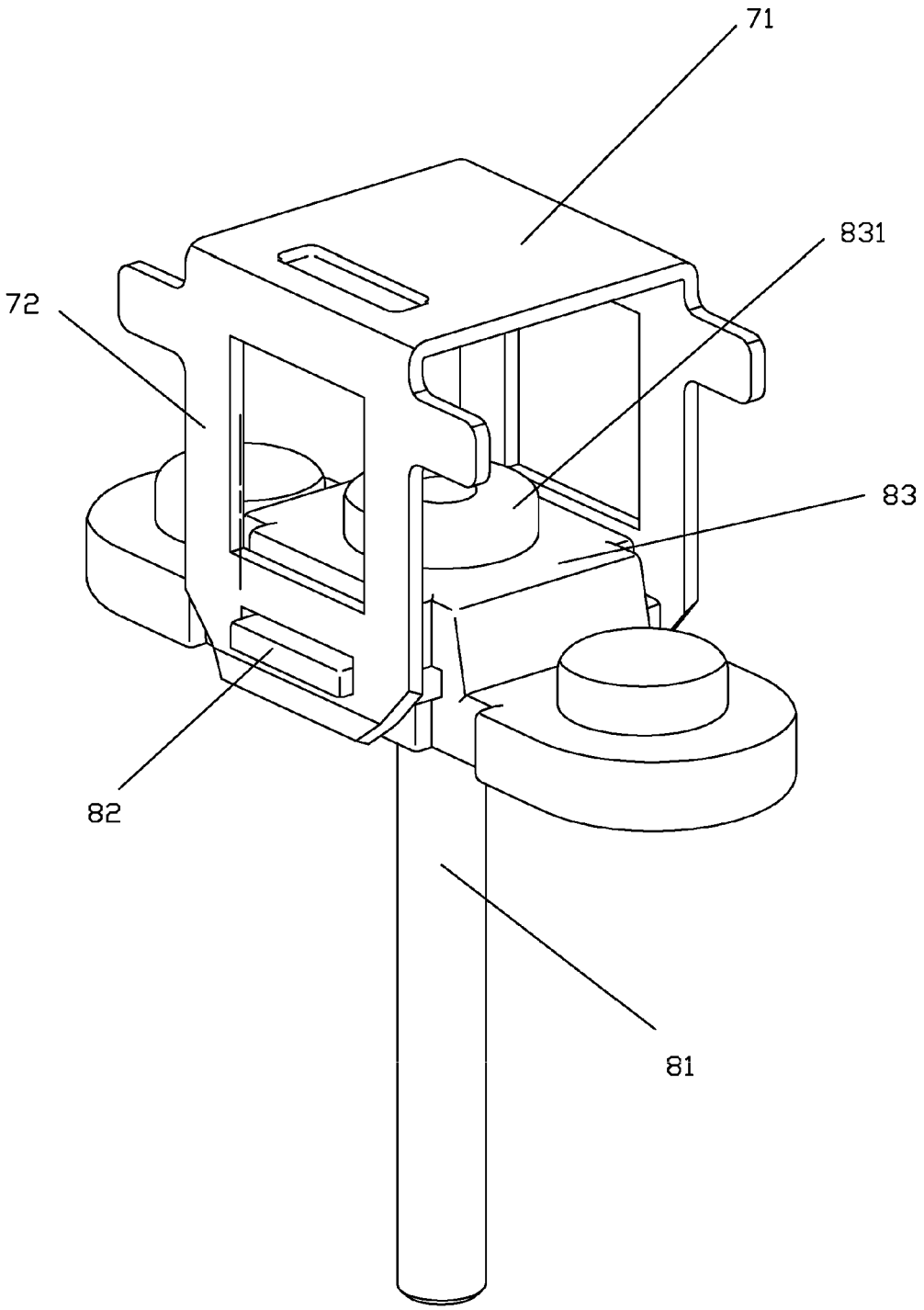
FIG. 6 is a schematic diagram of a pushing rod part adapted to a U-shaped basket of a high-voltage direct-current relay according to the first embodiment of the present disclosure.
Figure 7:
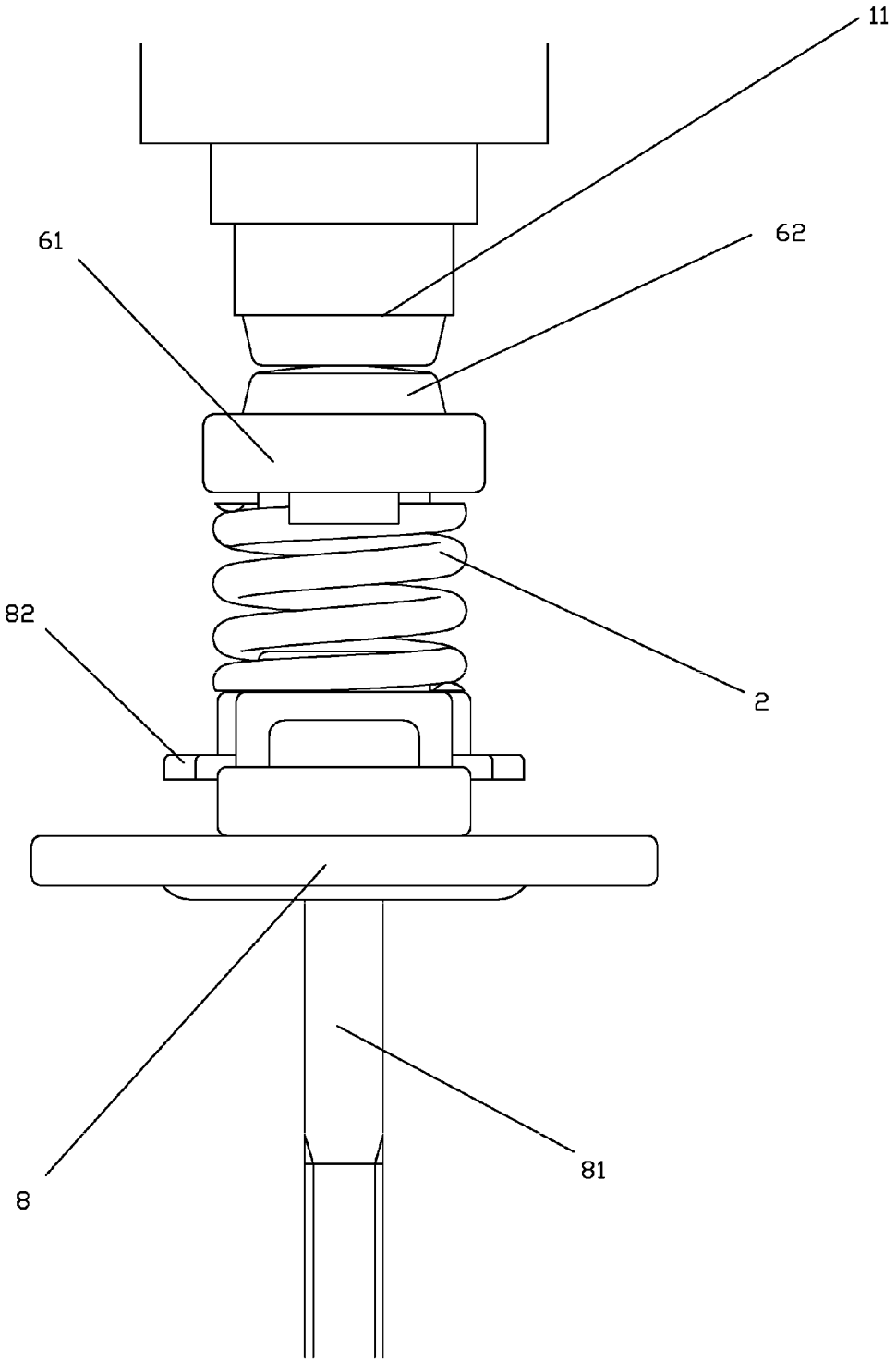
FIG. 7 is a partial schematic diagram of a high-voltage direct-current relay in accordance to the first embodiment of the present disclosure when the movable and stationary contact points are in contact.
Figure 8:
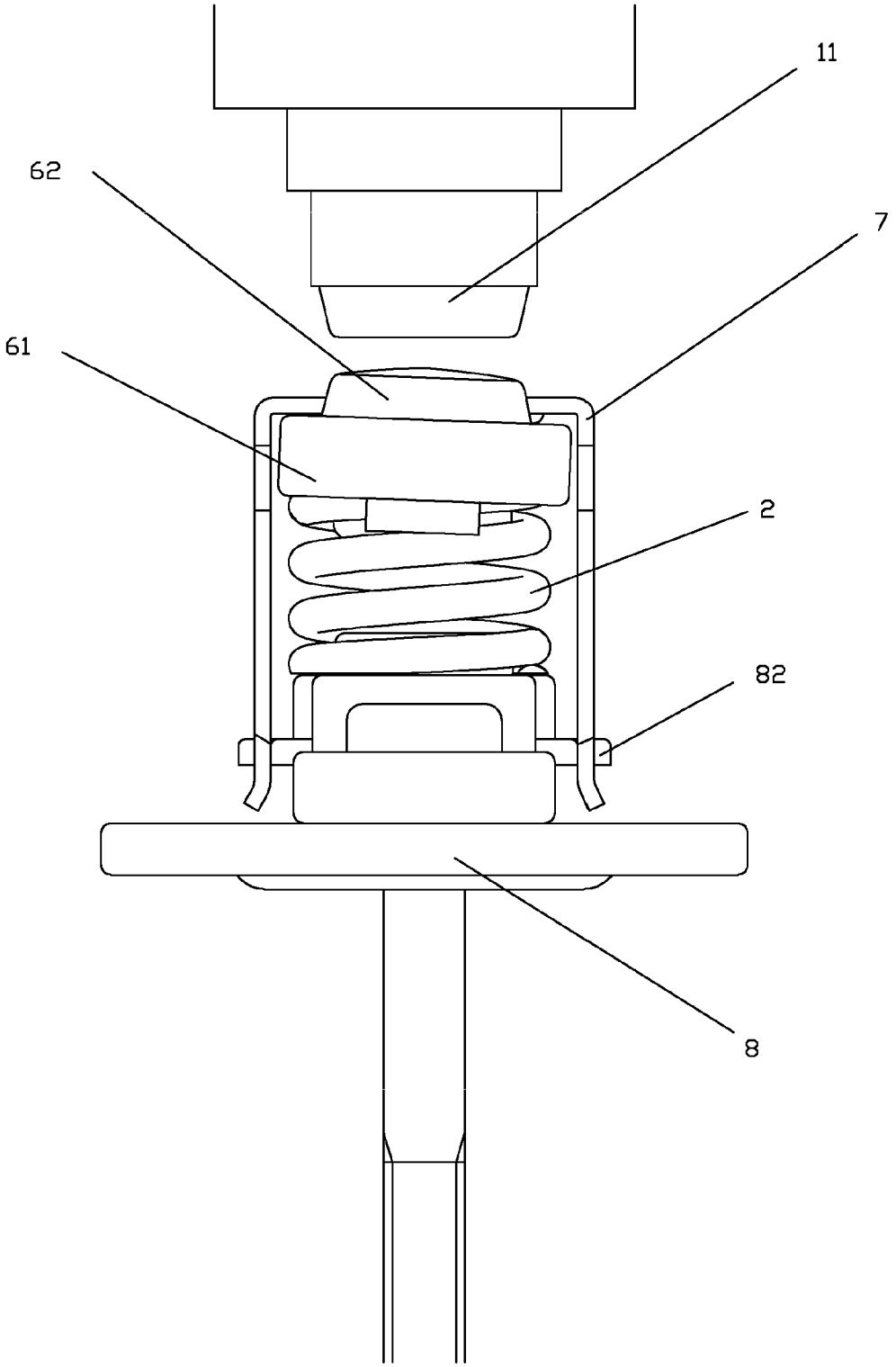
FIG. 8 is a partial schematic diagram of a high-voltage direct-current relay in accordance to the first embodiment of the present disclosure when the movable and stationary contact points are separated.

The technical solutions described in the present disclosure will be described in detail below with reference to the accompanying drawings and embodiments.

First Embodiment

Referring to FIGS. 1 to 9, a high-voltage direct-current relay of the present disclosure includes two stationary contacts 11, 12, a movable assembly, and a movable iron core 3, a yoke 4, a coil 5 and other component.

The movable assembly includes a movable spring part 6, a main spring 2 and a pushing rod assembly. The movable spring part 6 is composed of a movable spring 61 and movable contact points 62 at both ends of the movable spring. The pushing rod assembly is composed of a pushing rod part 8 and a U-shaped basket 7 made of metal material as two separate parts. The U-shaped basket has an inverted U shape with an opening downward, and is composed of a top part 71 and two side parts 72. The pushing rod part 8 includes a fixed piece 82 and a pushing rod 81 fixed together with insulating plastic. The fixed piece 82 is also made of metal material. One end of the pushing rod 81 is connected with the fixed piece 82 through insulating plastic, and the other end of the pushing rod 81 is connected with the movable iron core 3. When the movable contact points 62 at both ends of the movable spring 61 contact with the stationary contact points of the two stationary contacts 11 and 12 respectively, current flows into one of the stationary contacts, passes through the movable spring and flows from the other stationary contact. When current is applied to the coil 5 to move the movable iron core 3 upward, the movable iron core 3 drives the pushing rod assembly to move upwards, such that the movable contact points at both ends of the movable spring 61 contact the two stationary contacts 11 and 12 respectively. When the coil 5 is disconnected from the current, the movable iron core is moved downward by the action of the return spring, and the movable iron core 3 drives the pushing rod assembly to move downward, such that the movable contact points 62 at both ends of the movable spring 61 are separated from the two stationary contacts 11, 12 respectively. After the main spring 2, the movable spring part 6 and the U-shaped basket 7 are sequentially mounted on the top of the pushing rod part 8, the two ends of the fixing piece 82 are respectively fixed to the bottom of the side parts 72 of the U-shaped basket 7, such that the main spring 2 is elastically stretched between the bottom surface of the movable spring part 6 and the insulating plastic 83 of the pushing rod part 8, and the movable spring 61 of the movable spring part is pushed toward the inner side of the top part 71 of the U-shaped basket 7.

Figure 9:
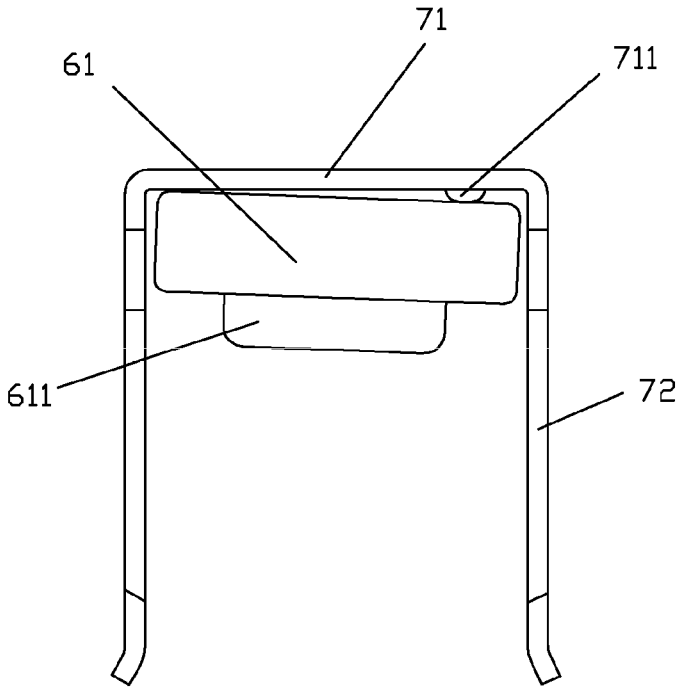
FIG. 9 is a schematic diagram illustrating the U-shaped basket adapted to the movable spring when the movable and stationary contact points of the high-voltage DC relay are separated, according to the first embodiment of the present disclosure.

In the present embodiment, a first lug 711 is provided on the inner side of the top part 71 of the U-shaped basket 7, and the first lug 711 is disposed on one side corresponding to the width of the movable spring 61, such that when the contact points are separated, due to the action of the lug 711 on the inner side of the top of the U-shaped basket 7 pressing against the movable spring 61, the movable spring 61 is inclined to one side of the width (as shown in FIG. 9).

In the present embodiment, the first lug 711 is formed by the die flushing from the corresponding position of the top part 71. Of course, it may also be formed by bending the corresponding position.

The bottom of the two side parts 72 of the U-shaped basket 7 is provided with a clamping hole 721. The two ends of the fixing piece 82 are respectively fitted into the clamping holes 721 of the two side parts 72, and the two ends of the fixing piece 82 are respectively fixed to the clamping holes 721 of the two side parts 72 of the U-shaped basket 7 by riveting. Of course, laser welding can also be used to achieve a fixed relationship between the two.

In both side parts 72 of the U-shaped basket 7 a reduction hole 722 for reducing the amount and weight of the material is also provided.

The fixing piece 82 and the pushing rod 81 are fixed together by injection molding. The insulating plastic 83 covers the upper surface of the fixing piece 82.

The insulating plastic 83 also protrudes upwards as a whole and is provided with a first boss 831 for limiting the main spring. The bottom end of the main spring 2 is sleeved on the first boss 831.

The bottom surface of the movable spring 61 is provided with a second boss 611 protruding downwards, and the top end of the main spring 2 is sleeved on the second boss 611.

The second boss 611 is formed by punching the movable spring 61 to form a lug.

A method for assembling a high-voltage direct-current relay according to the present disclosure includes an assembling step of a movable assembly. The step includes:

A. injection molding the fixed piece 82 and the pushing rod 81 into a one-piece pushing rod part 8;

B. sequentially mounting the main spring 2, the movable spring part 6, the U-shaped basket 7 on the top of the pushing rod part 8.

C. utilizing the characteristics that the two side parts 72 of the U-shaped basket 7 can be elastically opened, respectively snapping the two ends of the fixing piece 82 into the clamping holes 721 on the two side parts of the U-shaped basket, such that the main spring 2 is elastically tightened between the bottom surface of the spring part 6 and the insulating plastic 83 of pushing rod part 8, and the movable spring 61 of the movable spring part 6 is pressed against the inner side of the top part 71 of the U-shaped basket 7.

D. respectively fixing both ends of the fixing piece 82 to the clamping holes 721 on the bottom of the two side parts 72 of the U-shaped basket 7 by riveting or laser welding.

In the high-voltage direct-current relay according to the present disclosure, after the coil 5 is applied with the working current, the pushing rod 81 drives the U-shaped basket 7 and the movable spring upward, such that the two movable contact points 62 of the movable spring part respectively contact the two stationary contacts 11 and 12. Before the movable core 3 is moved into position, the pushing rod 81 drives the U-shaped basket 7 to continue to move upward. The movable spring part is blocked by the stationary contact and compresses the main spring 2, a gap is formed between the top part 71 of the U-shaped basket and the movable spring 61, and the movable spring is horizontal. When the coil 5 is disconnected from the current, the movable iron core 3 moves downwards, and the pushing rod 81 drives the U-shaped basket 7 to move downwards. As the movable iron core 3 continues to move downwards, the main spring 2 stretches to make the movable spring 61 to contact with the top part 71 of the U-shaped basket, and the movable spring inclines, such that the two movable contact points 62 of the movable spring part are separated from the stationary contact points of the two stationary contacts 11 and 12, respectively.

A high-voltage direct-current relay according to the present disclosure divides the pushing rod assembly into two separate parts of a U-shaped basket 7 and a pushing rod part 8. The U-shaped basket 7 is made of a metal material, and the pushing rod part 8 is integrally injection-molded by the pushing rod 81 and the fixing piece 82 made of a metal material. Since the parts involved in injection molding have a simple structure, the dimensional accuracy of the pushing rod part 8 can be easily ensured, and the difficulty in injection molding can be greatly reduced.

According to the present disclosure, a high-voltage direct-current relay divides the pushing rod assembly into two separate parts of a U-shaped basket 7 and a pushing rod part 8, and the U-basket 7 and the fixed piece 82 of the pushing rod part 82 adopt a clamping method. In the structure, the main spring 2, the movable spring part 6 and the U-shaped basket 7 are sequentially mounted on the top of the pushing rod part 8 to facilitate the assembly of the movable spring part 6 and the main spring 2. Such structure can adopt a "bottom-up" assembly method, and is easy to implement automated assembly.

In the high-voltage direct-current relay of the present disclosure, a first lug 711 is provided on the inner side of the top part 71 of the U-shaped basket 7, and the first lug 711 is disposed on one side corresponding to the width of the movable spring 61, such that when the contact points are separated, due to the action of the inner first lug 711 of the U-shaped basket 7 pressing against the movable spring 61, the movable spring 61 is inclined to one side of the width. With such structure of the present disclosure, when the contact points are separated, the movable spring 61 is inclined under the tension of the main spring 2 such that the arc point is separated from the contact point to ensure a small contact resistance. When the contact points are closed, the movable spring 61 starts to tilt to the level of the movable spring (that is, the final reliable contact between the movable contact point and the stationary contact point), such that the movable contact point and the stationary contact point "rolled" during the contact process, thereby effectively preventing stuck and improving the anti-stuck capability.

Second Embodiment

Figure 10:
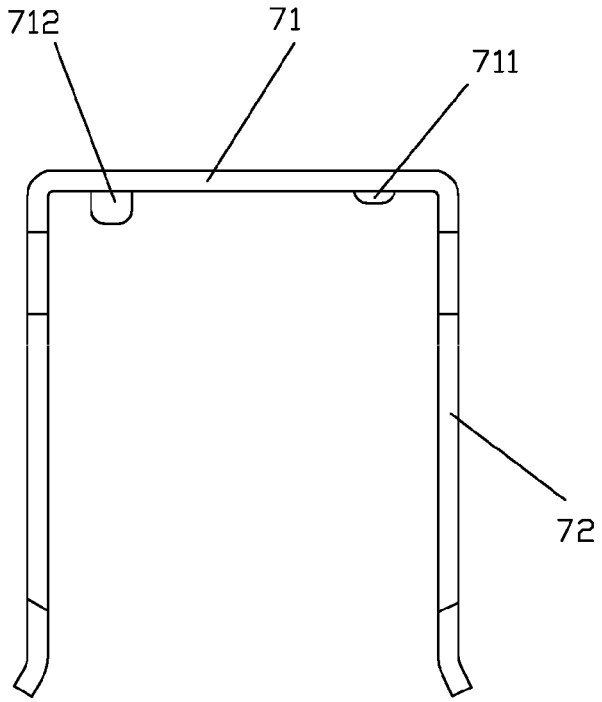
FIG. 10 is a front view of a U-shaped basket of a high-voltage direct-current relay according to a second embodiment of the present disclosure.
Figure 11:
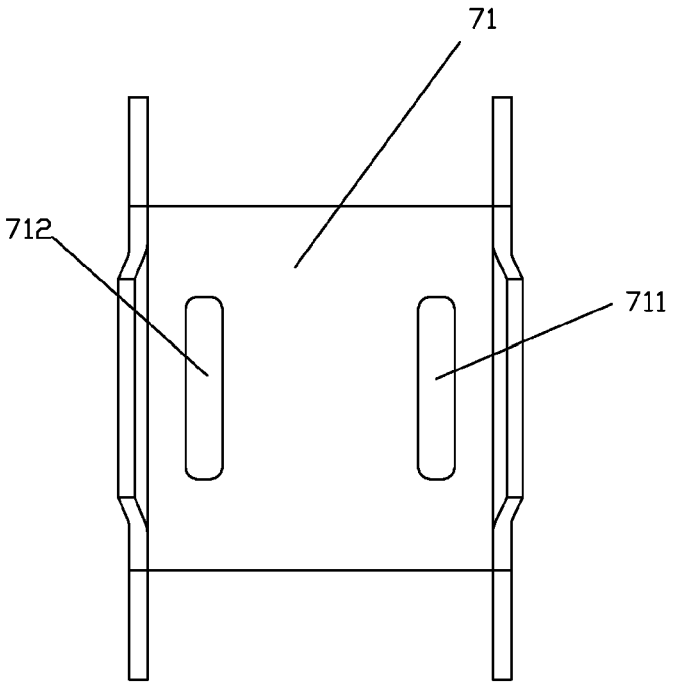
FIG. 11 is a bottom view of a U-shaped basket of a high-voltage direct-current relay according to the second embodiment of the present disclosure.
Figure 12:
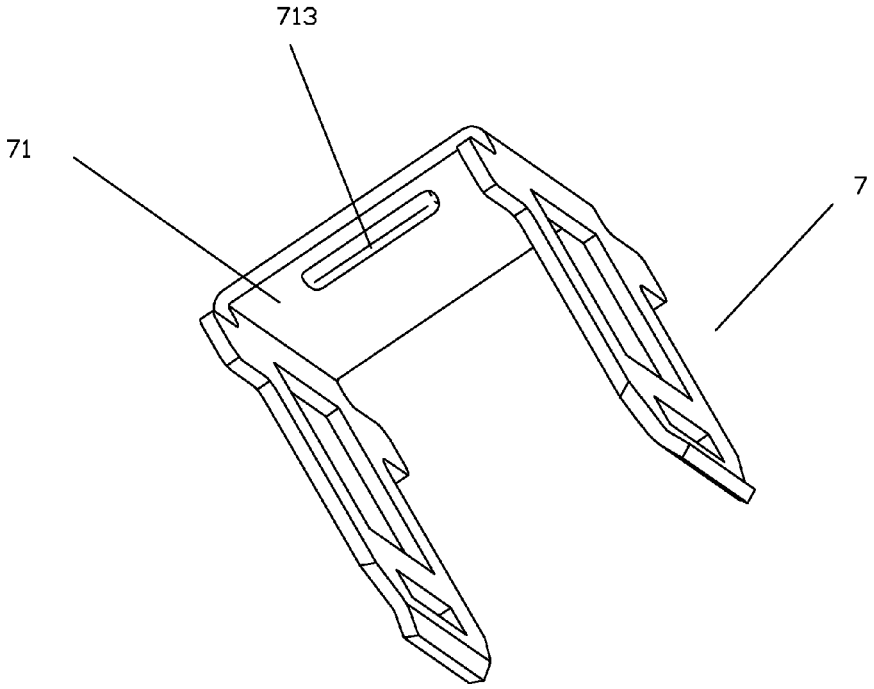
FIG. 12 is a three-dimensional structural schematic diagram of a U-shaped basket of a high-voltage direct-current relay according to a third embodiment of the present disclosure.
Figure 13:
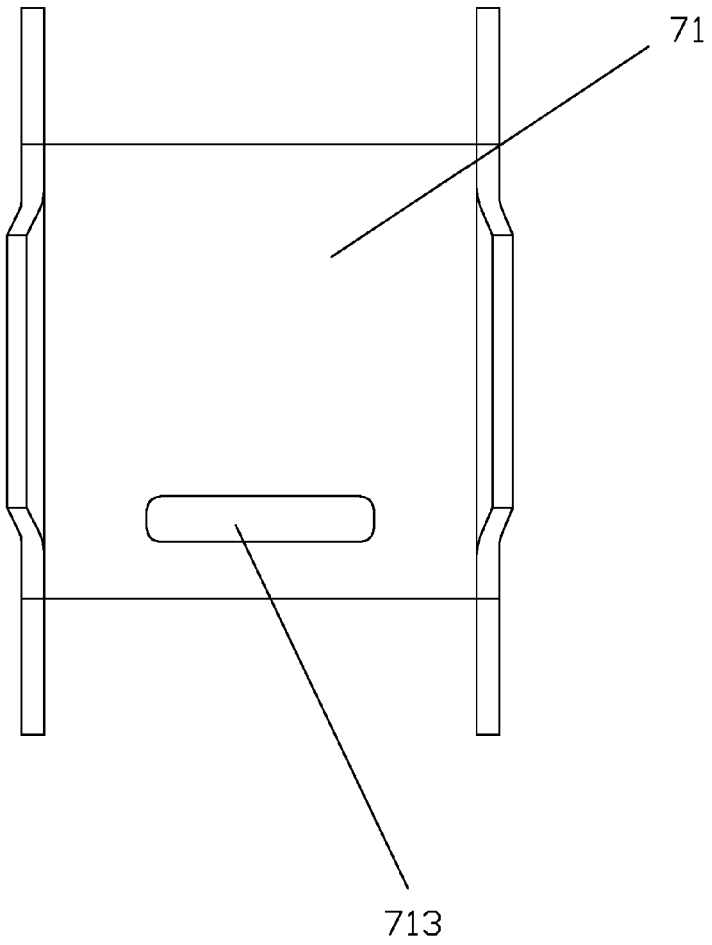
FIG. 13 is a bottom view of a U-shaped basket of a high-voltage direct-current relay according to the third embodiment of the present disclosure.

Referring to FIG. 10 to FIG. 11, a high-voltage direct-current relay according to the present disclosure is different from the first embodiment in that a second lug 712 is further disposed on the inner side of the top part 71 of the U-shaped basket 7. The second lug 712 is disposed on the other side corresponding to the width of the movable spring, and the height of the second lug 712 is set to have a height difference from the height of the first lug 711. In the present embodiment, the height of the lug 712 is greater than the height of the first lug 711, such that when the contact points are separated, due to the action of the inner side of the top part 71 of the U-shaped basket 7 pressing against the movable spring 61, the movable spring 61 is inclined to the other side of the width.

The second lug 712 is formed by bending the corresponding position of the U-shaped basket top part 71 or formed by die punching.

Third Embodiment

Figure 14:
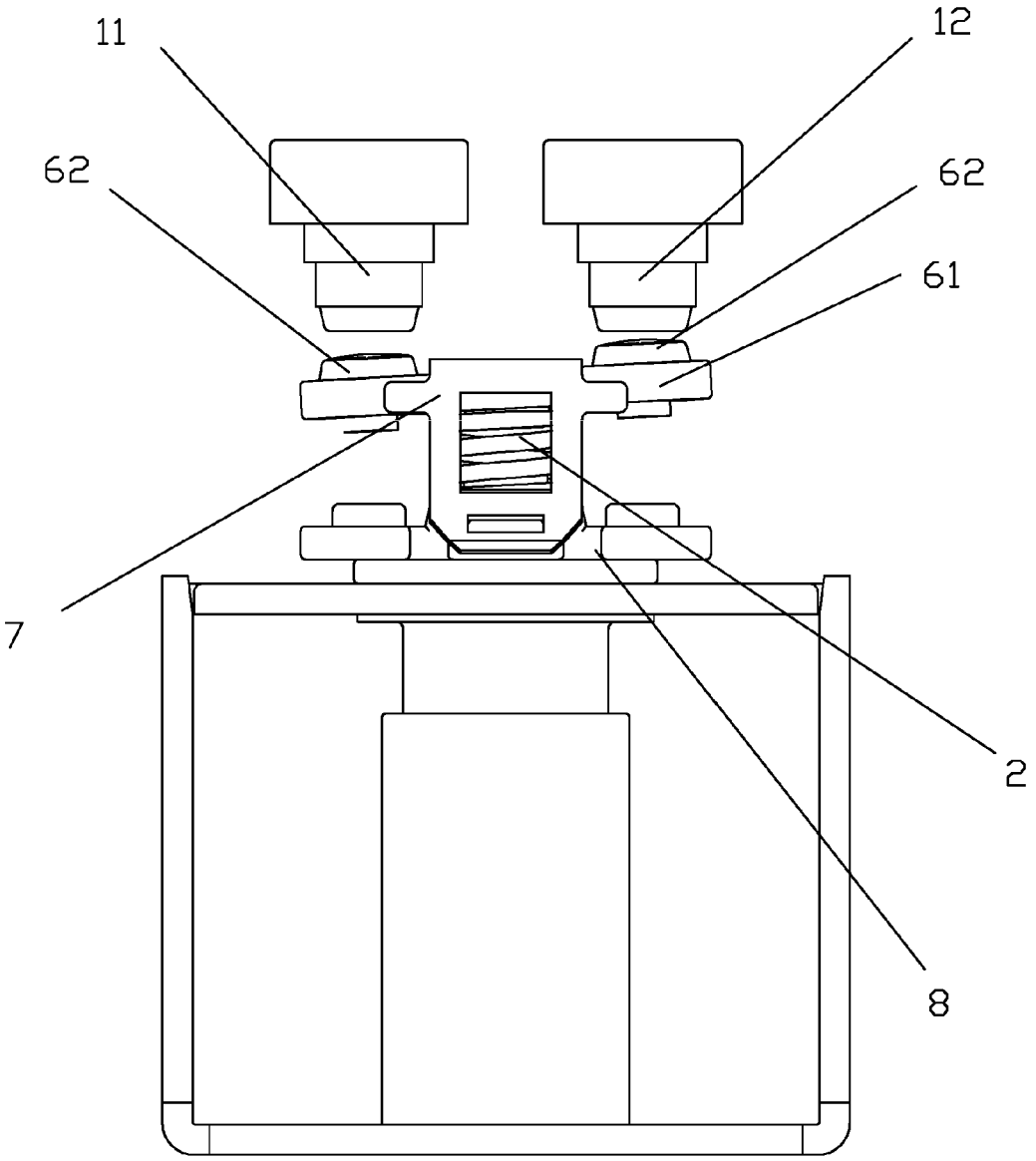
FIG. 14 is a front view of a high-voltage direct-current relay according to the third embodiment of the present disclosure.
Figure 15:
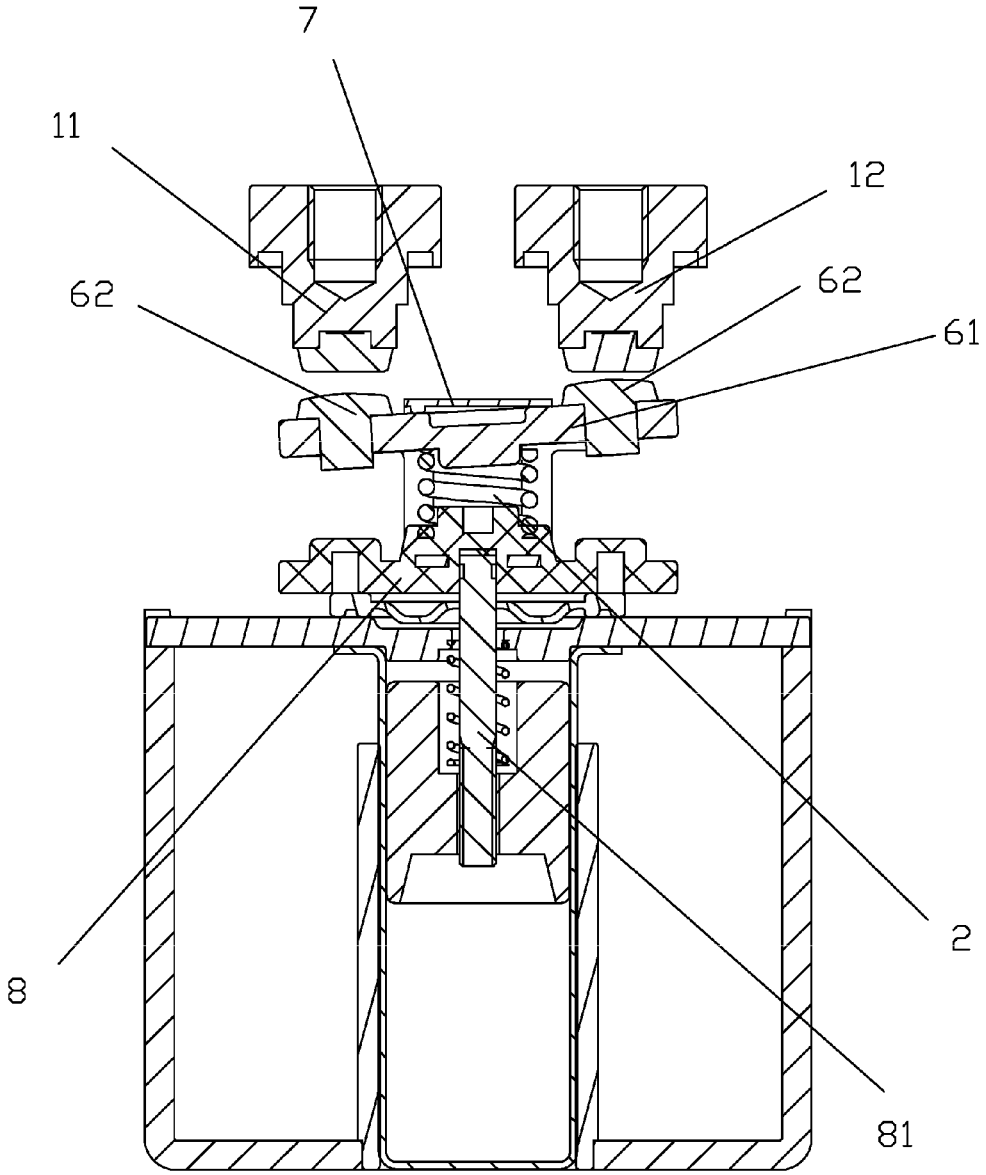
FIG. 15 is a schematic structural diagram of a high-voltage direct-current relay according to the third embodiment of the present disclosure.

Referring to FIGS. 12 to 15, a high-voltage direct-current relay according to the present disclosure differs from the first embodiment in that there is no first lug provided at the side corresponding to the width of the movable spring on the inner side of the top part of the U-shaped basket, instead, a third lug 713 is provided on the side corresponding to the length of the movable spring. With the third lug 713, when the contact points are separated, under the action of the third lug 713 on the inner side of the top part 71 of the U-shaped basket 7 pressing against the movable spring 61, the movable spring 61 is inclined to one side of the length (as shown in FIGS. 14 and 15).

The third lug 713 is formed by bending the corresponding position of the U-shaped basket top part 71 or formed by die punching.

In the high-voltage direct-current relay of the present disclosure, with the third lug 713 provided on the inner side of the top part 71 of the U-shaped basket, which is disposed on one side corresponding to the length of the movable spring 61 such that when the contact points are separated, under the action of the third lug 713 on the inner side of the top part of the U-shaped basket pressing against the movable spring 61, the movable spring is inclined to one side of the length. With such structure of the present disclosure, the movable spring part 6 may be inclined in the length direction of the movable spring. When the contact points are separated, one of the contacts is first disconnected, and then the other contact point is disconnected. It may be performed with a relatively small separation force. Therefore, when the movable contact point and the stationary contact are stuck, the inclination can greatly improve the separation ability of the product.

Fourth Embodiment

Figure 16:
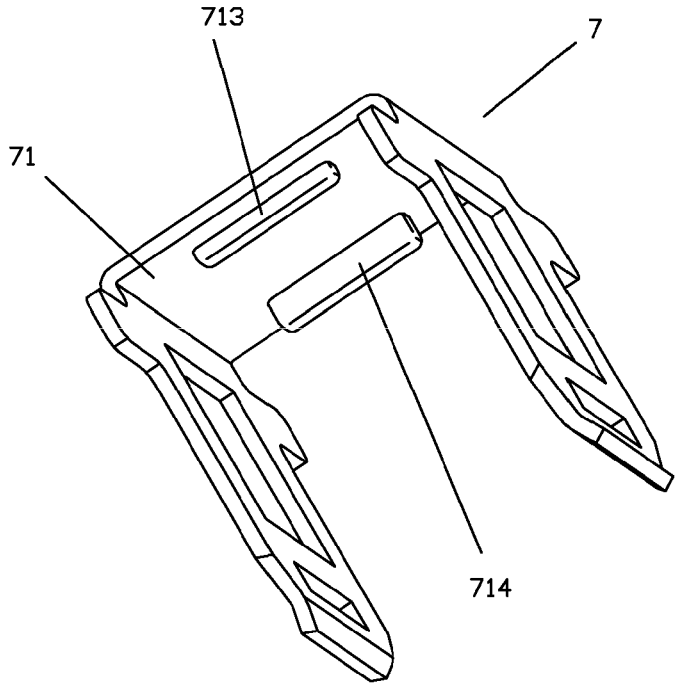
FIG. 16 is a three-dimensional structural schematic diagram of a U-shaped basket of a high-voltage direct-current relay according to a fourth embodiment of the present disclosure.
Figure 17:
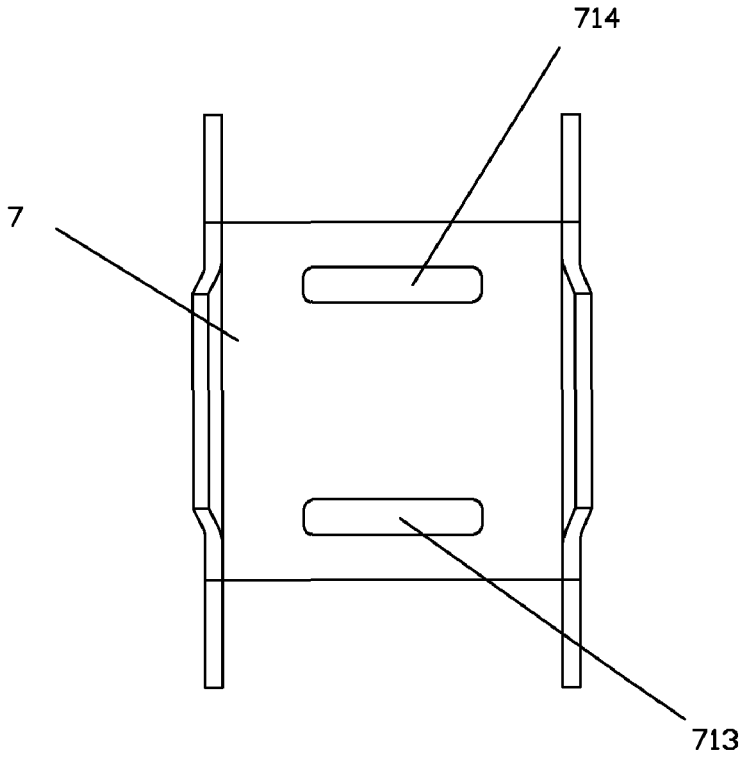
FIG. 17 is a bottom view of a U-shaped basket of a high-voltage direct-current relay according to the fourth embodiment of the present disclosure.

Referring to FIGS. 16 to 17, a high-voltage direct-current relay of the present disclosure differs from the third embodiment in that a fourth lug 714 is further provided on the inner side of the top part 71 of the U-shaped basket 7. The fourth lug 714 is disposed on the other side corresponding to the length of the movable spring, and the height of the fourth lug 714 is set to have a height difference from the height of the third lug 713. In this embodiment, the fourth lug 714 has a height greater than the height of the third lug 713, such that when the contact points are separated, under the action of the inner side of the top part 71 of the U-shaped basket 7 pressing against the movable spring 61, the movable spring 61 is inclined to the other side of the length.

The fourth lug 714 is formed by bending the corresponding position of the U-shaped basket top part 71 or formed by die punching.

Fifth Embodiment

Figure 18:
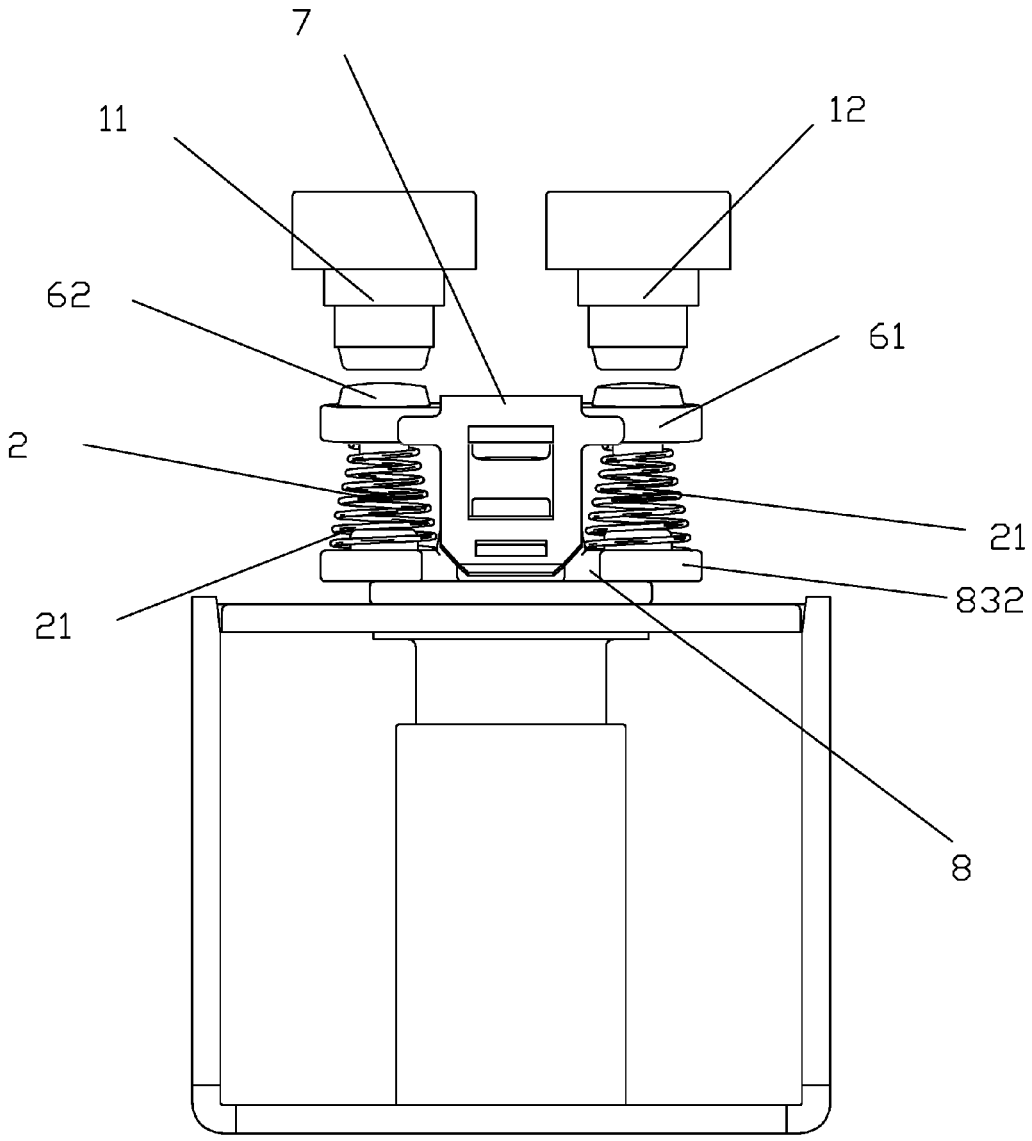
FIG. 18 is a front view of a high-voltage direct-current relay according to a fifth embodiment of the present disclosure.
Figure 19:
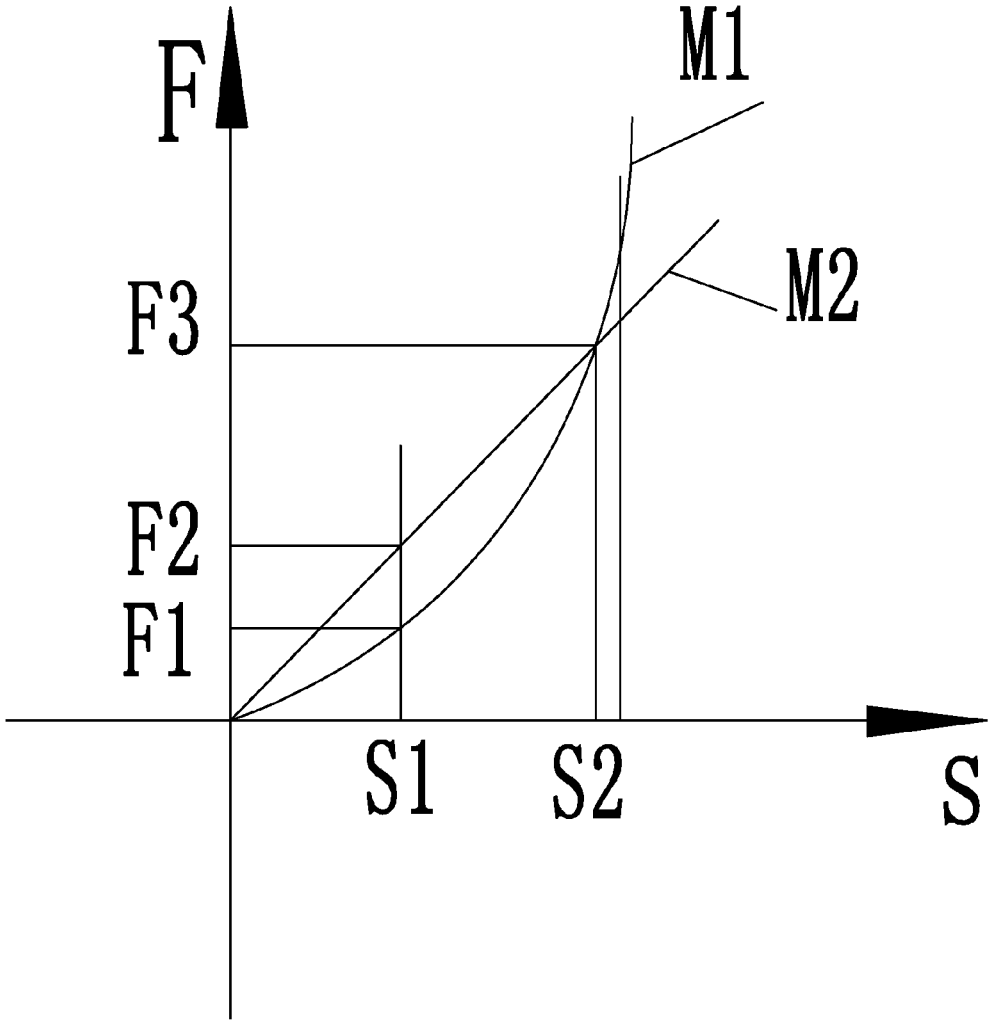
FIG. 19 is a schematic graph of force and displacement characteristics of a conical spring and a cylindrical spring used in a high-voltage direct-current relay according to the fifth embodiment of the present disclosure.

Referring to FIG. 18 to FIG. 19, a high-voltage direct-current relay according to the present disclosure is different from the first embodiment in that there are two main springs 2, and the pushing rod part 8 further includes spring support parts 832 respectively extending from the two sides of the insulating plastic 83. The bottom ends of the two main springs 2 abut against the two spring support parts 832, respectively.

The main spring 2 is a conical structure 21.

In the high-voltage direct-current relay of the present disclosure, due to the adoption of the two conical springs 21, the structure of the present disclosure can ensure that the operating voltage of the product is small while ensuring the contact pressure, or the contact pressure of the product can be designed to be large to provide reliable contact for the product while ensuring the operating voltage. This is desirable for resisting large fault currents.

In this embodiment, double cone springs 21 are adopted. The conical spring is also called a conical helix compression spring or a pagoda spring, as shown in FIG. 19. In the figure, M1 is a characteristic curve of force and displacement of a conical spring, and M2 is a characteristic curve of force and displacement of a cylindrical spring. M2 is actually a straight line. For the conical spring, the stiffness is non-linear, that is, its force slowly increases with displacement in the former part, and in the latter part, the force increases sharply as the compression amount increases. This differs significantly from the characteristic of the cylindrical spring which has a constant stiffness and straight characteristic line. In the former part of the displacement, the force F2 of the cylindrical spring is larger than the force F1 of the conical spring.

The DC product of the present disclosure is a "spiral tube" monostable structure, the operating voltage of the product and the contact pressure of the product (F3 in FIG. 19) and the initial tension force (as in FIG. 19: the conical spring F1, the cylindrical spring F2) is directly related, the greater the initial tension is, the greater the operating voltage is. As shown in FIG. 19, when the final pressure F3 is the same, the initial tension F1 of the conical spring is smaller than the initial tension F2 of the cylindrical spring, so the operating voltage thereof is relatively small. Similarly, the contact pressure of the product can be made large while ensuring the operating voltage.

The above is only preferred embodiments of the present disclosure and does not impose any limitation on the present disclosure. Although the present disclosure has been disclosed in the above preferred embodiments, it is not intended to limit the present disclosure. Any person skilled in the art can make many possible variations and modifications to the technical solutions of the present disclosure, or modify equivalent embodiments, without departing from the scope of the technical solutions of the present disclosure. Therefore, any content that does not depart from the technical solutions of the present disclosure, any simple alterations, equivalent changes, and modifications made to the above embodiments according to the technical essence of the present disclosure shall fall within the protection scope of the technical solutions of the present disclosure.

What is claimed is:

1. A high-voltage direct-current relay comprising two stationary contacts and a movable assembly, the movable assembly comprising a movable spring part, a main spring and a pushing rod assembly, wherein the pushing rod assembly is composed of a pushing rod part and a U-shaped basket as two separate parts, the movable spring part is composed of a movable spring and a movable contact point at each of a first and a second end of the movable spring, the U-shaped basket having an inverted U shape and including a top part and two side parts extending downwardly therefrom, each side part having a top and a bottom, the pushing rod part comprises a fixing piece having two ends and a pushing rod fixed together with insulating plastic, the fixing piece being made of metal material and formed in a shape of a flat plate, after the main spring, the movable spring part and the U-shaped basket are sequentially mounted on a top of the pushing rod part, the two ends of the fixing piece are respectively secured to the bottoms of the side parts of the U-shaped basket, such that the main spring is elastically tightened between a bottom surface of the movable spring part and the insulating plastic of the pushing rod part, and the movable spring of the movable spring part is pressed to an inner side of the top part of the U-shaped basket.

2. The high-voltage direct-current relay according to claim 1, wherein the bottoms of the side parts of the U-shaped basket are respectively provided with a clamping hole, and the two ends of the fixing piece are respectively assembled in the clamping holes, and the two ends of the fixing piece are respectively fixed to the clamping holes of the side parts of the U-shaped basket by riveting or laser welding.

3. The high-voltage direct-current relay according to claim 1, wherein the number of the main spring is one, the insulating plastic further protrudes upwards as a whole and is provided with a first boss for limiting the main spring, and the bottom end of the main spring is sleeved on the first boss.

4. The high-voltage direct-current relay according to claim 3, wherein the bottom surface of the movable spring part is provided with a second boss protruding downwards, and a top end of the main spring is sleeved on the second boss.

5. The high-voltage direct-current relay according to claim 1, wherein the number of the main springs is two, and the pushing rod part further comprises spring support parts respectively extending from the two sides of the insulating plastic, the bottoms of the two main springs respectively abut against the two spring support parts.

6. The high-voltage direct-current relay according to claim 1, wherein the inner side of the top of the U-shaped basket is provided with a first lug, and the first lug is disposed on one side corresponding to a width of the movable spring, such that when the movable contact points are separated from the stationary contacts, under the action of the first lug on the inner side of the top part of the U-shaped basket pressing against the movable spring, the movable spring is inclined to one side of the width.

7. The high-voltage direct-current relay according to claim 6, wherein the first lug is formed by bending a corresponding position on the top part of the U-shaped basket or by die punching.

8. The high-voltage direct-current relay according to claim 6, wherein a second lug is further disposed on the inner side of the top part of the U-shaped basket, the second lug is disposed on a second side corresponding to the width of the movable spring, and a height of the second lug is set to have a height difference from a height of the first lug, such that when the movable contact points are separated from the stationary contacts, due to the action of the inner side of the top part of the U-shaped basket pressing against the movable spring, the movable spring is inclined to the other side of the width.

9. The high-voltage direct-current relay according to claim 8, wherein the second lug is formed by bending a corresponding position on the top part of the U-shaped basket or by die punching.

10. The high-voltage direct-current relay according to claim 1, wherein a third lug is provided on the inner side of the top part of the U-shaped basket, and the third lug is disposed on one side corresponding to a length of the movable spring, such that when the movable contact points are separated, under the action of the third lug on the inner side of the top part of the U-shaped basket pressing against the movable spring, the movable spring is inclined to one side of the length.

11. The high-voltage direct-current relay according to claim 10, wherein the third lug is formed by bending a corresponding position on the top part of the U-shaped basket or by die punching.

12. The high-voltage direct-current relay according to claim 10, wherein a fourth lug is disposed on the inner side of the top part of the U-shaped basket, the fourth lug is disposed on the other side corresponding to the length of the movable spring, and the height of the fourth lug is set to have a height difference from the height of the third lug, such that when the contact points are separated, under the action of the inner side of the top part of the U-shaped basket pressing against the movable spring, the movable springs are inclined to one side of the length.

13. The high-voltage direct-current relay according to claim 12, wherein the fourth lug is formed by bending a corresponding position on the top of the U-shaped basket or formed by die punching.

14. A method for assembling a high-voltage direct-current relay, comprising steps of:

A. forming a fixing piece having two ends and a pushing rod into a one-piece pushing rod part by injection mold, the fixing piece being made of metal material and formed in a shape of a flat plate, the pushing rod part having an insulating plastic on an upper surface;

B. sequentially mounting a main spring, a movable spring part and a U-shaped basket on a top of the one-piece pushing rod part, the movable spring part comprising a movable spring, the U-shaped basket having an inverted U shape and including a top part and two side parts extending downwardly therefrom, each side part having a top and a bottom;

C. utilizing the characteristics that the two side parts of the U-shaped basket can be elastically opened, respectively snapping the two ends of the fixing piece into clamping holes on the two side parts of the U-shaped basket, such that the main spring is elastically tightened between a bottom surface of the movable spring part and the insulating plastic of the pushing rod part, and pressing the movable spring of the movable spring part against an inner side of the top part of the U-shaped basket; and D. fixing the two ends of the fixing piece respectively to the clamping holes on the bottom of the two side parts of the U-shaped basket by riveting or laser welding.

* * * * *